US008667888B2

(12) United States Patent
Ottestad

(10) Patent No.: US 8,667,888 B2
(45) Date of Patent: Mar. 11, 2014

(54) FLEXIBLE CHAMBER

(75) Inventor: Nils T. Ottestad, Husoysund (NO)

(73) Assignee: Ottelstad Breathing Systems AS, Husousund (NO)

( * ) Notice: Subject to any disclaimer, the term of this patent is extended or adjusted under 35 U.S.C. 154(b) by 756 days.

(21) Appl. No.: 12/743,913

(22) PCT Filed: Nov. 19, 2008

(86) PCT No.: PCT/NO2008/000413

§ 371 (c)(1),
(2), (4) Date: Jul. 26, 2010

(87) PCT Pub. No.: WO2009/075581

PCT Pub. Date: Jun. 18, 2009

(65) Prior Publication Data

US 2010/0296954 A1 Nov. 25, 2010

(30) Foreign Application Priority Data

Nov. 20, 2007 (NO) ..... 2007 5970

(51) Int. Cl.
*F01B 31/00* (2006.01)
*F01B 19/00* (2006.01)
*F01B 21/02* (2006.01)

(52) U.S. Cl.
USPC ..... 92/130 B; 92/135; 92/64

(58) Field of Classification Search
USPC ..... 417/472; 92/34, 52, 62, 66, 85 B, 134, 92/130, 130 R, 130 B, 135
See application file for complete search history.

(56) References Cited

U.S. PATENT DOCUMENTS

| | | | | | |
|---|---|---|---|---|---|
| 3,394,631 | A * | 7/1968 | Thompson | 92/46 |
| 3,582,237 | A * | 6/1971 | Grantham | 417/377 |
| 3,934,423 | A * | 1/1976 | Haller | 92/52 |
| 4,041,845 | A * | 8/1977 | Mean et al. | 92/85 A |
| 4,096,785 | A * | 6/1978 | Wirges | 91/416 |
| 4,336,746 | A * | 6/1982 | Morith | 92/130 B |
| 4,442,757 | A * | 4/1984 | Goans | 92/82 |
| 4,445,424 | A * | 5/1984 | Foster et al. | 92/5 R |
| 4,523,516 | A * | 6/1985 | Foster et al. | 92/130 B |
| 4,791,856 | A * | 12/1988 | Heim et al. | 92/84 |
| 5,099,748 | A * | 3/1992 | Neubauer | 91/26 |
| 5,404,983 | A * | 4/1995 | Eicher et al. | 192/143 |
| 6,851,349 | B2 * | 2/2005 | Dohallow | 91/169 |
| 2004/0003847 | A1 * | 1/2004 | Ottestad | 137/505.15 |

FOREIGN PATENT DOCUMENTS

GB 1 244 158 8/1971

OTHER PUBLICATIONS

International Search Report issued Feb. 25, 2009 in International (PCT) Application No. PCT/NO2008/000413.
Patent Cooperation Treaty (PCT) Written Opinion of the International Searching Authority issued Feb. 15, 2009 in International (PCT) Application No. PCT/NO2008/000413.

* cited by examiner

*Primary Examiner* — Charles Freay
*Assistant Examiner* — Alexander Comley
(74) *Attorney, Agent, or Firm* — Christian D. Abel

(57) ABSTRACT

A chamber having an internal volume, end surfaces and a side wall. The chamber is adapted to change its volume by leakage-free displacement of the end surface. The side wall has at least three adjacent sleeves (1-6), and an elastic seal (8-14) is arranged between each of the sleeves, such that the seals are pressurized and expanded when the sleeves are moved due to a displacement of the end surfaces.

5 Claims, 5 Drawing Sheets

A

B

FLEXIBLE CHAMBER

FIELD OF THE INVENTION

The present invention is related to a chamber which is able to amend the volume by displacement free of leakage of a surface element, constituting one of the end surfaces of the chamber. The side walls of the chamber comprise a selected number of sleeves which is free of leakage are joint by means of elastic seals. The chamber according to the invention is characterized in that the volume of the chamber will vary when small variances occur in the balance between the forces effecting said surface elements and that this property to a very small instant is effected by the difference between the internal and the external pressure of the chamber.

BACKGROUND

Chambers which have end surfaces being displaceable free of leakage and which vary the volume by varying the direct action against this end surface, are used for different purpose such as transmission of power, pressure metering, switching functions and such. The relevant chambers in this connection may be corrugated bellows produced in metal or in a soft material, or cylindric chambers where the change of volume occurs by displacement of an elastic membrane or a piston with sliding seal. In many connections it is desirable that the volume of the chamber may be effected by only small changes in the load balance effecting the displaceable end surface. This may easily be achieved with the difference between the internal and external pressure of the chamber can be kept at a low level. It becomes substantially more difficult when the difference between the internal and external pressure exceeds for example 250 bar. If a corrugated bellow is to withstand pressure differences of this magnitude, it must be dimensioned very strongly and a significant change of volume therefore will require a large change in the direct action. Correspondingly a membrane or a traditional soft sliding seal will be squeezed if they are exposed for large pressure differences and only small changes of the volume can be achieved before the seals are damaged. Different high pressure sliding seals are produced of a suitable material, but they have a large sliding friction and therefore limited range of use.

SUMMARY OF THE INVENTION

For a chamber according to the present invention, the surface element may be easily displaceable even if there are more than 1000 bar difference between the internal and external pressure of the chamber. This is due to, in relation to a situation where the balance between the forces effecting the displaceable surface element, only the elastic forces in the soft seals must be overcome to achieve displacement. The invention is based on the following two conditions which must be fulfilled for a soft seal to withstand large pressure differences and simultaneously avoid leakage between the components which are displaced in relation to each other. The one condition is that the mutual displacement occurs without said seal being displaced in relation to its contact surfaces, as the displacement only can results in an elastic change of the form of the seal. The other condition is that the seal must be arranged in a groove where the opening towards the lowest pressure is so narrow that the seal as such cannot be pressed into this opening.

The fulfillment of the first condition is limiting the mutual displacement of said components to a few tenth of millimeters, depending of the thickness of the seal ring and the elastic properties. It is normally desirable that the surface element may be displaced at least 1 mm, readily substantially more. This is achieved by the chamber according to the invention is designed such that the volume is amended by elastic deformation of many single-seals. The side walls of the chamber thereby consist of a selected number of sleeves which are interconnected in a row free of leakage, with an elastic seal at every transition. The volume of the chamber also is a altered by mutual displacement of these sleeves and a corresponding elastic form change of the seals in between. The displacement of the surface element thereby will be the total sum of the mutual displacement of the sleeves. By this embodiment the seals suffer little wear and therefore will have a long lifetime.

BRIEF DESCRIPTION OF THE DRAWINGS

The invention will be disclosed in the following with reference to the figures where FIG. 1 discloses a soft seal in the shape of an o-ring, which according to the invention is arranged in a suitable groove between two sleeves, FIG. 2 discloses a preferred embodiment of complete chamber according to the invention, FIG. 3 discloses the use of a chamber according to the invention where the surface element provides the pressure sensitive element in a high pressure regulator, FIG. 4 discloses a chamber according to the invention used as a pulsation dampener and FIG. 5 discloses a chamber according to the invention implemented in a high pressure pump.

DETAILED DESCRIPTION OF THE INVENTION

The soft seal rings used may preferably be o-rings as such are reasonable cheap and have a suitable shape. The invention, however is not limited to use this type of seals. Principally any type of seal may be used which can be adapted to a groove where the seal only is exposed for an elastic deformation when the components in question are mutually displaced. For example can seals being used which are molded or vulcanized as an elastic coupling free of leakage between the mutually displaceable components of the chamber. The following disclosure only will focus on the use of o-rings for the benefit of simplicity.

Figure 1:
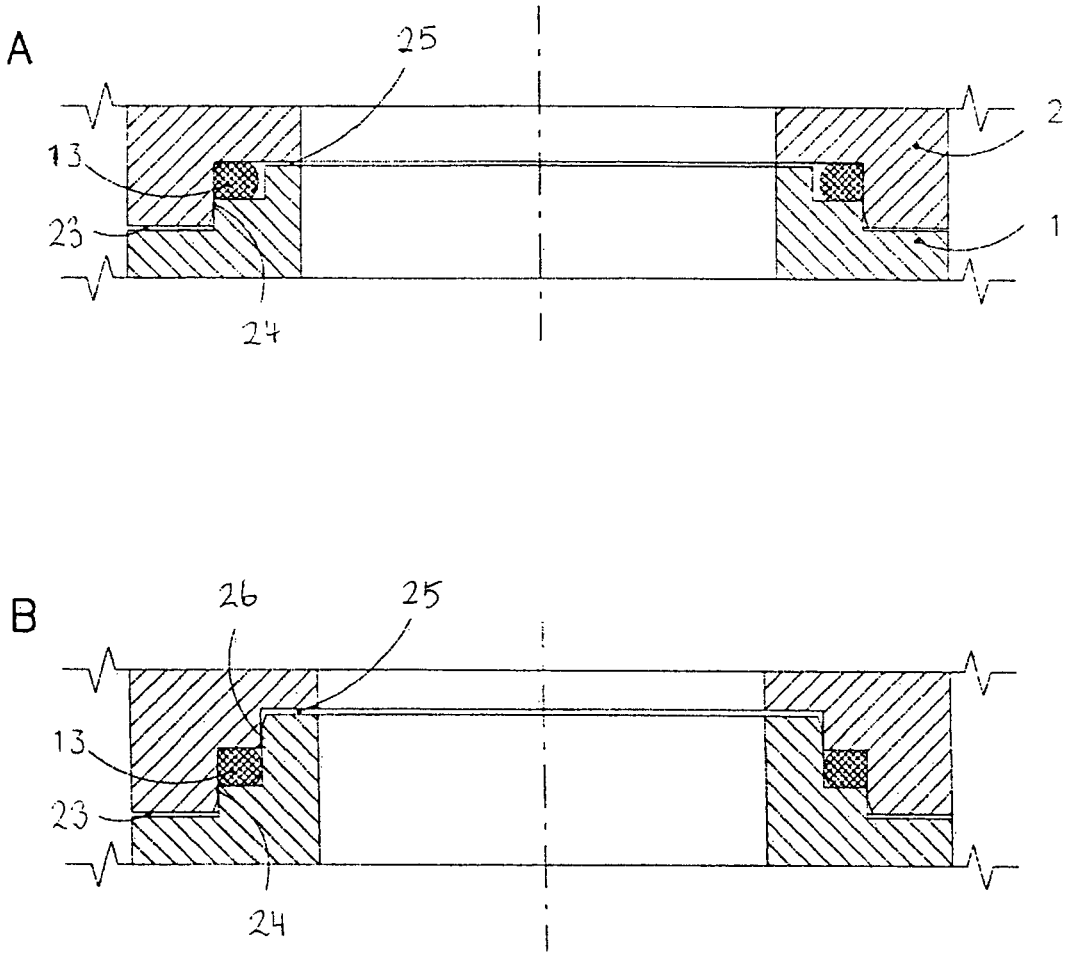

FIG. 1A is a section of a chamber according to the invention and discloses an o-ring arranged in a groove between two sleeves 1, 2. This embodiment of the groove is suitable when the highest pressure is within the chamber, i.e. on the inside of the sleeves. In this situation the o-ring is pressed radially out in the groove. This groove is shaped with a narrow clearance 24 which is maintained narrow when the sleeves are mutually displaced along the dotted center line and therefore allow the exposure of the o-ring to be at a very high pressure without pressing the seal out of the groove and being destroyed. FIG. 1A indicates a situation where the sleeves 1, 2 have the maximum allowed distance. In practice, however, this situation means that the height of the groove is a few tenth of a millimeter less than the cross section diameter of the o-ring. The sleeves will preferably be provided with a (not disclosed) device preventing that the height of the groove can be too large. The sleeves maximum may pressed together until the distance between the clearings 23 or 25 is zero.

FIG. 1B discloses a section of an o-ring groove which may be suitable in case the o-rings should withstand a large differential pressure and at the same time changing between which side has the highest pressure. Accordingly narrow clearances 24, 26 are arrange on both sides of the o-ring groove. To prevent that the o-ring is forced to slide backwards and forwards with different pressure directions, in this situation preferably a narrower o-ring groove is used, ensuring that the o-ring most likely will be exposed only for elastic deformation.

Figure 2:
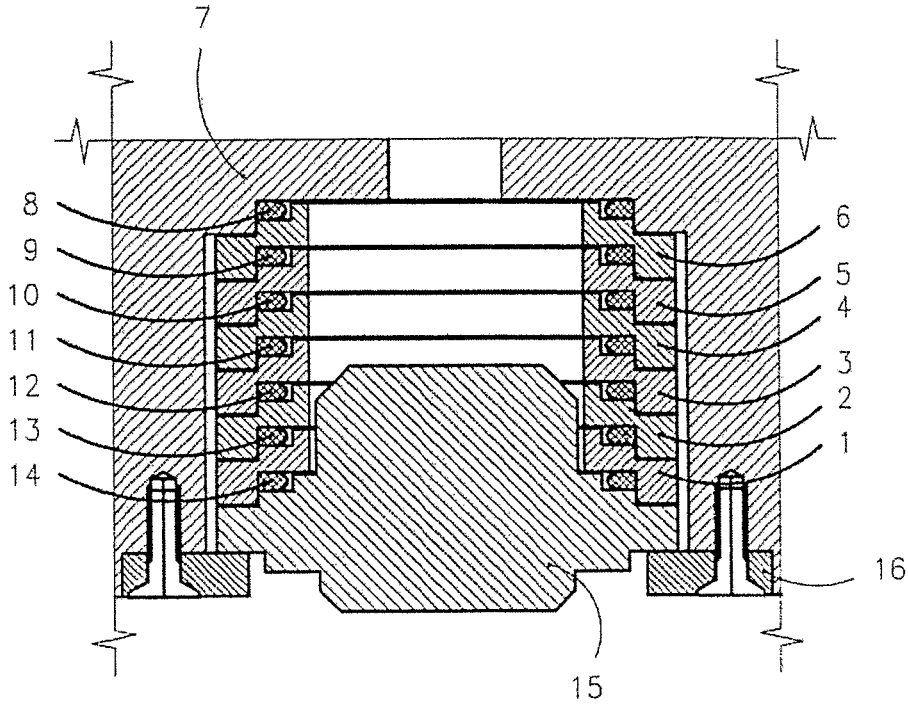
Figure 2:
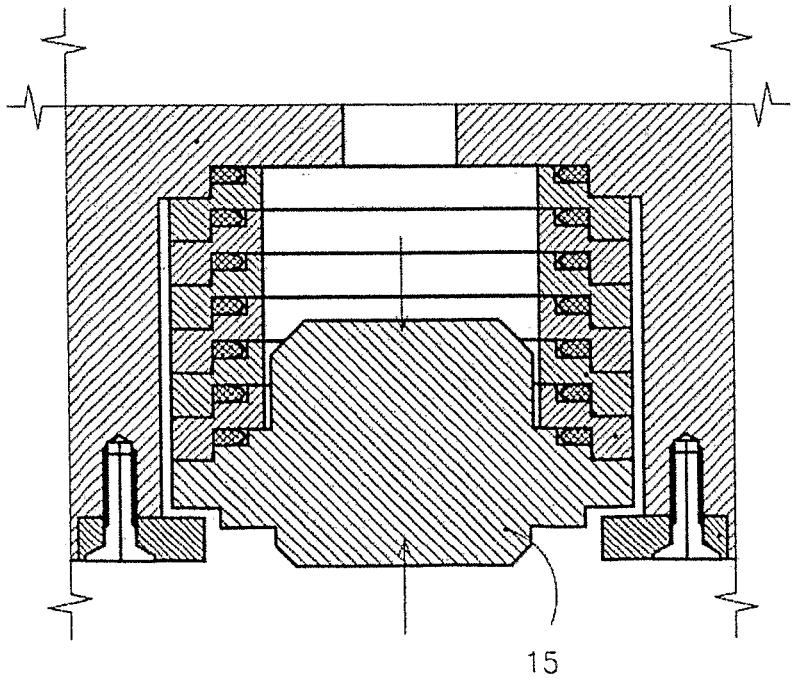

FIG. 2 discloses an embodiment of a complete chamber according to the is invention, adapted for a high internal pressure. This chamber consists of a fixed bottom piece 6, 6 sleeves 1-6, 7 o-rings 8-14 as well as a surface element 15. FIG. 2A discloses the chamber in a completely relaxed situation. This means that the groove depth of the o-rings are on the highest allowable value. Here is arranged a stop ring 16 preventing further expansion of the chamber. As already mentioned, it may be suitable to use means (not disclosed in the figure) preventing that the mutual distance between the sleeves exceeds an acceptable value. FIG. 2B discloses the chamber correspondingly compressed nearly to the minimum volume.

For the chamber to change the volume it is necessary to displace the surface element by using forces in the direction indicated by arrows. For a displacement to occur, an approximate equilibrium between the forces effecting the surface element should exist. The forces against the surface element normally is a combination above spring force and pressure due to the difference between the internal and the external pressure of the chamber. It o-rings are uses having a sectional diameter of 1.78 mm, each sealing will allow a mutual displacement of around 0.2 mm. The chamber in question comprises 7 sealings allowing the surface element 15 to have a maximum travel of 1.4 mm. This will be suitable for some purposes which for example use high pressure regulators. In other connections it may be suitable to use a chamber with a substantially higher number of sleeves and/or to use thicker o-rings.

Figure 3:
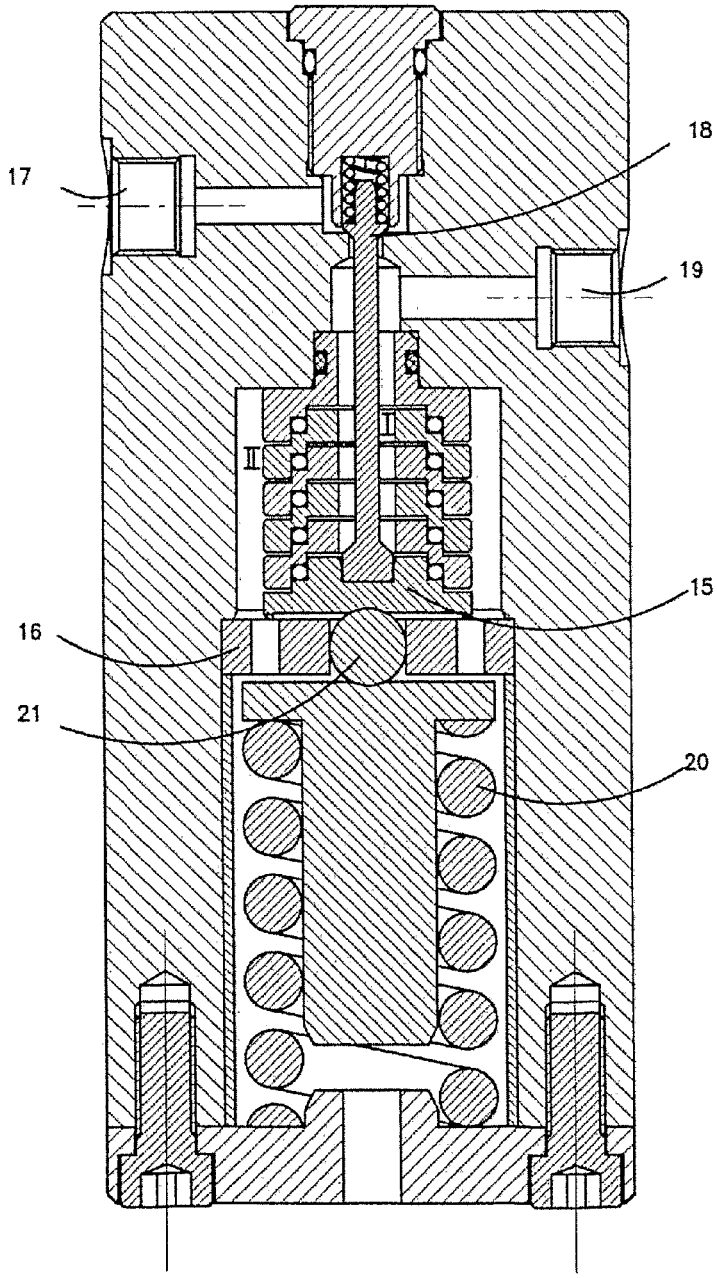

FIG. 3 discloses a relevant embodiment of the pressure valve based on a chamber according to the invention, The valve provides fluid through the inlet 17 and delivers fluid through the outlet 19 which has an open connection with the chamber I. The chamber II has an open connection to the atmosphere, which means that the valve has the atmospheric pressure as reference pressure.

The valve typically can be adjusted to deliver hydraulic fluid at a pressure of 690 barg. This means that the spring 20 is preloaded in such a way that an upwardly directed spring force to the underside of the surface element 15 is in balance with the pressure forces effected to the upper side of the surface element 15 due to the pressure difference of 690 barg between chamber I and chamber II. The valve immediately will counteract a fall in the delivery pressure by displacing the surface element 15 upwardly and forcing the valve body 18 to open for supply of fluid through the inlet 17.

In a valve of the above type, the spring 20 must have a powerful preload. The effective pressure surface on the pressure recording element typically will be in the dimension of 1.5 $cm^2$. This means that the preload of the spring will exceed 1 ton. It must avoided that these spring forces act unsymmetrically whereby wear damage may occur and instability in the function of the valve. In FIG. 3 it is indicated how it can be ensured that the forces are effective along the centre axis of the valve by transferring the spring force to the surface element 15 by means of a ball 21 in a central guiding of a stop washer 16.

Normally it will be desired that the outlet pressure of the valve can be adjusted stepless. By traditional low pressure valves and adjustment screw may be arranged, which adjusts the preload of the control spring. In a valve of the present type the spring preload is so large that it is more relevant to utilize the pressure energy in the supplied fluid to displace a piston which thereby compresses the package of springs. Such solutions are not part of the present invention and will therefore not be further described.

Figure 4:
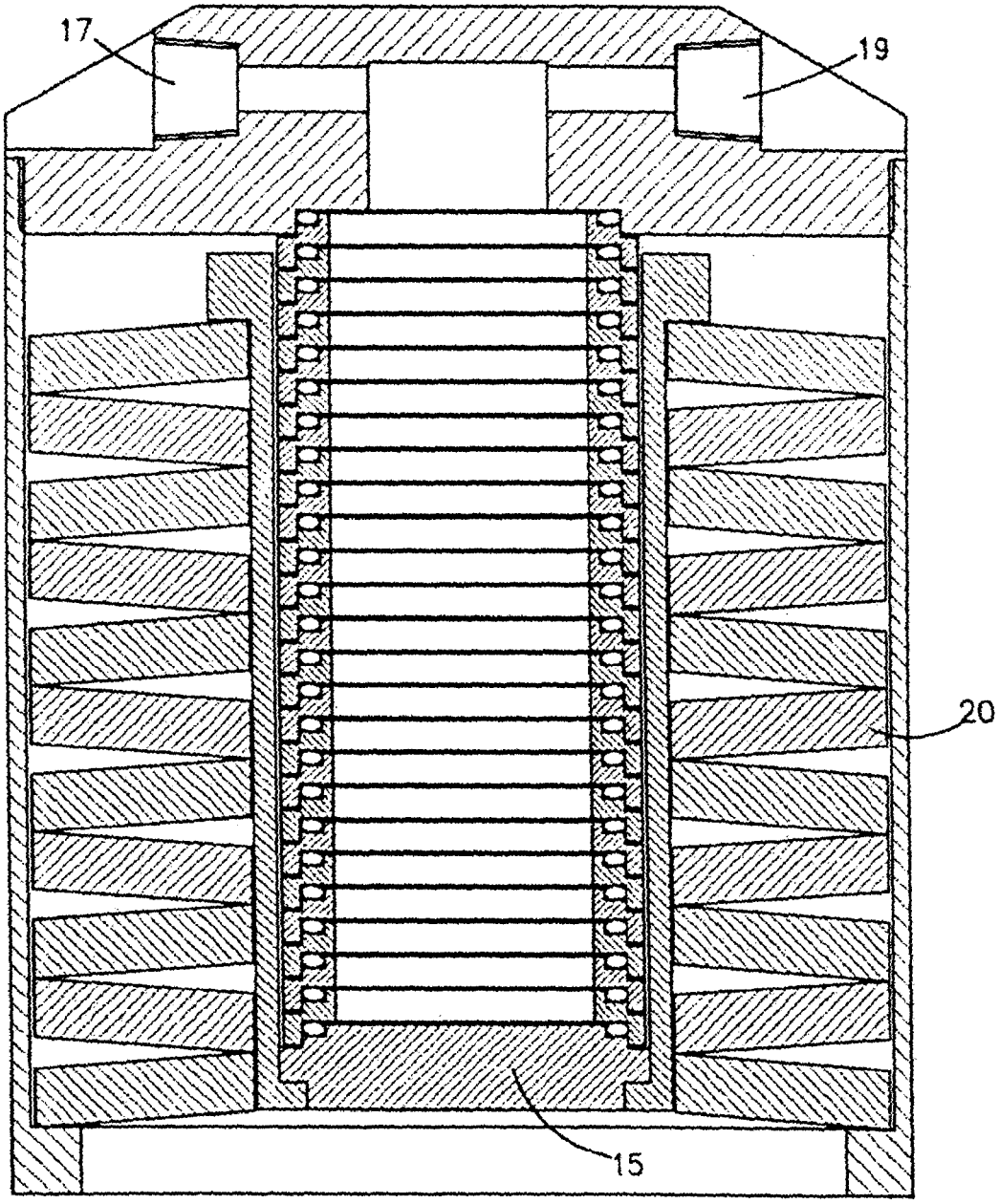

FIG. 4 discloses an embodiment of a pulsation dampener based on a chamber according to the invention. Said pulsation dampener is adapted to reduce pressure pulses in a cyclic irregular fluid flow from a piston pump where the chamber acts as an elastic volume absorbing variations in the flow and ensuring a smoother fluid flow at the outlet 19 of the pulsation dampener than is the case at the inlet 17.

It is usual to absorb this type of pulsations by connecting the outlet of the pump to an elastic volume in the shape of a gas filled bladder. Such gas filled bladders are arranged in a pressure withstanding container mounted on the downstream side of the pump. The pulsation dampener as disclosed in FIG. 4 can for example be adapted to operate at pumping pressures up to preferably 700 bar. The diameter of the chamber may typically be 50 mm, resulting in the displacement surface element 15 will have an effecting pressure surface of about 20 $cm^2$. The downwardly directed pressure forces thereby will be of a size of $F=700\ kp/cm^2*2\ cm^2=1.4$ ton. To ensure that the chamber should act as an elastic volume, the forces effecting the surface element 15 must be approximately in balance. This is achieved by controlling the preload of the powerful cup springs 20. The chamber must be dimensioned in such a way that it may change the volume sufficiently to absorb the fluctuations of the pump fluid delivery.

To make the start of the pump easier attempts may be made to conduct large part of the fluid flow back to the sucking side at the start of the pump, later thereby gradually to throttle this return. It is therefore desirable that the pulsation dampener may function from approximately zero delivery pressure and up to the maximum delivery pressure of the pump. This may be achieved by using as many sleeves that the link of the chamber may be changed corresponding to the length of the spring package from it is approximately idle and until it this compressed in such a way that the spring force reaches 1.4 ton. Even with this utilization the pressure energy of the fluid supply may be utilized to perform automatic change of the spring preload as earlier mentioned. Such solutions are not part of the present invention, and will therefore not be described.

A pulsation dampener according to the invention especially has two important advantages in relation to a pulsation dampener based on a gas filled bladder. The one advantage is that with simple means, the pulsation dampener may function across a large pressure area, whereas a pulsation dampener having a gas bladder must be preloaded with a pressure adjusted to the pressure area at which the pulsation dampener shall function. The other advantage is that the cost of maintenance may be substantially reduced as there is little wear on the components included. In a pulsation dampener based on a gas bladder, the bladder continuously must be refilled with gas and additionally the bladder is exposed to strains which lead to frequent replacement.

Figure 5:
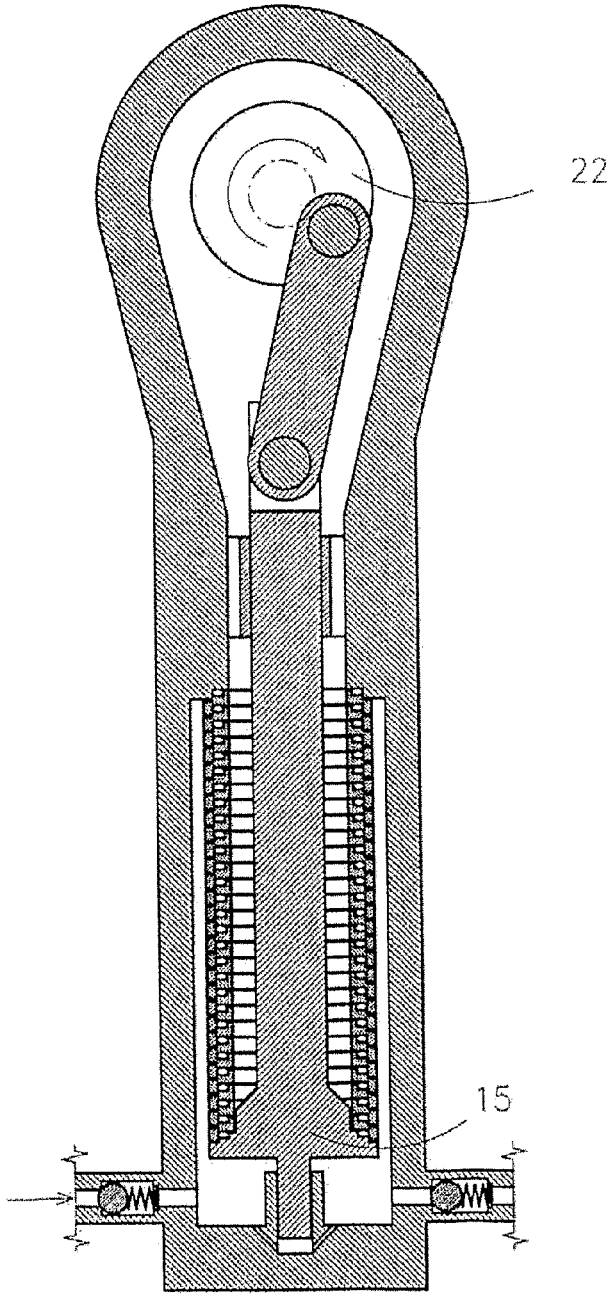

FIG. 5 discloses a principle sketch for a pump based on a chamber according to the present invention adapted to deliver fluid at high pressure. In this embodiment the displaceable element function as a piston, by an electric motor via a crank shaft 22.

The chamber according to the invention may be used in almost all connections where small or large pressure differences should be utilized to provide movement or force. By combining use of chambers having different diameters, high pressure pneumatic or hydraulic pumps may be provided based on low pressure fluid, pressure amplifier and such. It is therefore emphasized that the utilization area should not be limited to the embodiment described.

The invention claimed is:

1. A chamber comprising an internal volume, an end surface and a side wall, the chamber adapted to change the volume by leakage-free displacement of a surface element (15) constituting said end surface, characterized in that the side wall comprises at least three adjacent rigid sleeves (1-6), and an elastic seal (8-14) is arranged between each of the sleeves, such that the seals are pressurized and expanded when the sleeves are moved due to a displacement of the surface element (15), said displacement resulting in a decreased internal volume.

2. Chamber according to claim 1, characterized in that each elastic seal (8-14) is arranged between the sleeves, or between the surface element and an adjacent rigid sleeve, in such a way that the seal is not stretched or compressed beyond defined, predetermined measures.

3. Chamber according to claim 1, characterized in that each elastic seal (8-14) comprises an O-ring being arranged in a groove provided between the sleeves, or between the surface element and an adjacent rigid sleeve, and the height of said groove is changed when the sleeves and the surface element are displaced.

4. Chamber according to claim 1, characterized in that each elastic seal (8-14) is moulded, or vulcanized, as an elastic coupling free of leakage between the sleeves and between the surface element and an adjacent rigid sleeve.

5. Chamber according to claim 1, characterized in that each elastic seal (8-14) is arranged in a groove having narrow clearances (24, 26) preventing the seal (8-14) from being pressed out of the groove due to the influence of pressure forces.

* * * * *